US012030156B2

(12) United States Patent
Brown et al.

(10) Patent No.: US 12,030,156 B2
(45) Date of Patent: Jul. 9, 2024

(54) POLISHING CARRIER HEAD WITH PIEZOELECTRIC PRESSURE CONTROL

(71) Applicant: Applied Materials, Inc., Santa Clara, CA (US)

(72) Inventors: Brian J. Brown, Palo Alto, CA (US); Andrew J. Nagengast, Sunnyvale, CA (US); Justin Ho Kuen Wong, Pleasanton, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 17/355,024

(22) Filed: Jun. 22, 2021

(65) Prior Publication Data

US 2021/0402546 A1 Dec. 30, 2021

Related U.S. Application Data

(60) Provisional application No. 63/043,616, filed on Jun. 24, 2020.

(51) Int. Cl.

| | |
|---|---|
| ***B24B 37/005*** | (2012.01) |
| ***B24B 29/00*** | (2006.01) |
| ***B24B 37/10*** | (2012.01) |
| ***B24B 37/32*** | (2012.01) |

(Continued)

(52) U.S. Cl.

CPC ..... *B24B 37/005* (2013.01); *B24B 29/00* (2013.01); *B24B 37/10* (2013.01); *B24B 49/10* (2013.01); *B24B 37/32* (2013.01); *B24B 47/22* (2013.01)

(58) Field of Classification Search

CPC ..... B24B 37/005; B24B 37/10; B24B 37/32; B24B 37/013; B24B 29/00; B24B 49/10; B24B 49/12; B24B 47/22

See application file for complete search history.

(56) References Cited

U.S. PATENT DOCUMENTS 5,720,845 A * 2/1998 Liu ..... B24B 37/30 438/692
6,270,397 B1 8/2001 Wu
6,579,151 B2 6/2003 Tseng (Continued)

FOREIGN PATENT DOCUMENTS

CN 1185028 6/1998
CN 1288252 3/2001

(Continued)

OTHER PUBLICATIONS

English translation of JP 4519972B2 (Year: 2010).*

(Continued)

*Primary Examiner* — Joel D Crandall
*Assistant Examiner* — Sukwoo James Chang
(74) *Attorney, Agent, or Firm* — Fish & Richardson P.C.

(57) ABSTRACT

A carrier head for holding a substrate in a polishing system has a housing including a carrier plate, a first flexible membrane secured to the housing, and a plurality of independently operable piezoelectric actuators secured to the carrier plate. The first flexible membrane has an upper surface and having a lower surface that provides a substrate mounting surface. The piezoelectric actuators are positioned above the first flexible membrane so as to independently adjust compressive pressure on the upper surface of the first flexible membrane.

18 Claims, 7 Drawing Sheets

(51) Int. Cl.
*B24B 47/22* (2006.01)
*B24B 49/10* (2006.01)

(56) References Cited

U.S. PATENT DOCUMENTS

| | | | | |
|---|---|---|---|---|
| 6,623,343 | B2 | 9/2003 | Kajiwara | |
| 6,722,965 | B2 | 4/2004 | Zuniga et al. | |
| 8,540,550 | B2 | 9/2013 | Fujihira et al. | |
| 2004/0192173 | A1 | 9/2004 | Zuniga et al. | |
| 2006/0089092 | A1 | 4/2006 | Chen et al. | |
| 2006/0135040 | A1 | 6/2006 | Herold et al. | |
| 2006/0160473 | A1 | 7/2006 | Fujii et al. | |
| 2007/0004321 | A1 | 1/2007 | Elledge | |
| 2010/0217430 | A1 | 8/2010 | David et al. | |
| 2011/0256805 | A1 | 10/2011 | David et al. | |
| 2013/0237128 | A1 | 9/2013 | David et al. | |
| 2016/0279756 | A1 | 9/2016 | Chang et al. | |
| 2017/0304990 | A1 | 10/2017 | Chang et al. | |
| 2019/0096722 | A1 * | 3/2019 | Dhandapani | H01L 22/12 |
| 2020/0238471 | A1 | 7/2020 | Barkam et al. | |
| 2020/0243364 | A1 | 7/2020 | Kobata et al. | |
| 2021/0402547 | A1 | 12/2021 | Brown et al. | |

FOREIGN PATENT DOCUMENTS

| | | | | |
|---|---|---|---|---|
| CN | 1481295 | | 3/2004 | |
| CN | 104708529 | | 6/2015 | |
| JP | H11-165256 | | 6/1999 | |
| JP | 2000-006002 | | 1/2000 | |
| JP | 2000-202759 | | 7/2000 | |
| JP | 2000-246628 | | 9/2000 | |
| JP | 2000-296458 | | 10/2000 | |
| JP | 2001-150330 | | 6/2001 | |
| JP | 2001-212754 | | 8/2001 | |
| JP | 2001-239450 | | 9/2001 | |
| JP | 2006-524588 | | 11/2006 | |
| JP | 4519972 | B2 * | 8/2010 | B24B 37/30 |
| JP | 2019-072841 | | 5/2019 | |
| JP | 2019532825 | A * | 11/2019 | B24B 37/042 |
| JP | 2021-154421 | | 10/2021 | |
| KR | 10-2012-0103126 | | 9/2012 | |
| KR | 101387980 | B1 * | 4/2014 | B24B 49/12 |
| KR | 20170125382 | A * | 11/2017 | B24B 49/003 |
| TW | 200732087 | | 9/2007 | |
| TW | 201446411 | | 12/2014 | |
| WO | WO 2001/087541 | | 11/2001 | |
| WO | WO2015199815 | A1 * | 12/2015 | H01L 21/304 |
| WO | WO 2021/135849 | | 7/2021 | |

OTHER PUBLICATIONS

English translation of KR20170125382A (Year: 2017).*
English translation of JP2019532825A (Year: 2019).*
English translation of KR101387980B1 (Year: 2014).*
Office Action in TW Appln. No. 110123083, dated Mar. 14, 2022, 13 pages (with English search report).
International Search Report and Written Opinion in International Appln. No. PCT/US2021038537, dated Oct. 12, 2021, 13 pages.
Office Action in Japanese Appln. No. 2022-544710, dated Oct. 31, 2023, 6 pages (with English translation).
Office Action in Chinese Appln. No. 202180014450.4, dated Jun. 7, 2023, 24 pages (with English translation).
Office Action in Taiwanese Appln. No. 111149352, dated Sep. 20, 2023, 12 pages (with English summary and search report).

* cited by examiner

POLISHING CARRIER HEAD WITH PIEZOELECTRIC PRESSURE CONTROL

CROSS-REFERENCE TO RELATED APPLICATIONS

This claims priority to U.S. Provisional Application Ser. No. 63/043,616, filed on Jun. 24, 2020, the disclosure of which is incorporated by reference.

TECHNICAL FIELD

The present disclosure relates generally to profile control of a polishing process, and more particularly to a carrier head having piezoelectric actuators.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface and planarizing the filler layer. For certain applications, the filler layer is planarized until the top surface of a patterned layer is exposed. In addition, planarization may be used to planarize the substrate surface, e.g., of a dielectric layer, for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. In some situations, the carrier head includes a membrane that forms multiple independently pressurizable chambers, with the pressure in each chamber controlling the polishing rate in each corresponding region on the substrate. A polishing liquid, such as slurry with abrasive particles, is supplied to the surface of the polishing pad.

SUMMARY

In one aspect, a carrier head for holding a substrate in a polishing system has a housing including a carrier plate, a first flexible membrane secured to the housing, and a plurality of independently operable piezoelectric actuators secured to the carrier plate. The first flexible membrane has an upper surface and having a lower surface that provides a substrate mounting surface. The piezoelectric actuators are positioned above the first flexible membrane so as to independently adjust compressive pressure on the upper surface of the first flexible membrane.

In another aspect, a polishing system includes a platen to support a polishing pad, a carrier head to hold a substrate against the polishing pad, an in-situ monitoring system to generate a signal that depends on a thickness of a layer on the substrate being polished, and a control system. The carrier head includes a housing secured to and rotatable by the drive shaft, the housing including a carrier plate, a first flexible membrane secured to the housing, and a plurality of independently operable piezoelectric actuators. The first flexible membrane has an upper surface and a lower surface that provides a substrate mounting surface. The piezoelectric actuators are secured to the carrier plate and positioned above the first flexible membrane so as to independently adjust compressive pressure on the upper surface of the first flexible membrane. The plurality of piezoelectric actuators are arranged at different angular positions around a center axis of the carrier head. The controller is configured to control voltages applied to the plurality of piezoelectric actuators based on the signal from the in-situ monitoring system so as to reduce angular variation in thickness of the layer.

In another aspect, a polishing assembly includes a carrier head for holding a substrate in a polishing system, a drive shaft, a motor to rotate the drive shaft, a rotary electrical union, a controller, a voltage supply line, and a data line. The carrier head includes a housing secured to and rotatable by the drive shaft and including a carrier plate, a plurality of independently operable piezoelectric actuators, and circuitry secured to the housing. The piezoelectric actuators are secured to the carrier plate and positioned so as to independently adjust pressure on the substrate. The voltage supply line and the data line connects the controller to the circuitry through the rotary electrical union. The circuitry is configured to receive a voltage on a voltage supply line, receive data on a data line, and control voltages applied to the plurality of piezoelectric actuators based on the data.

In another aspect, a carrier head for holding a substrate in a polishing system includes a housing, a first flexible membrane secured to the housing to form one or more pressurizable chambers to apply pressure through a central membrane portion of the first flexible membrane to a central portion of a substrate, and a plurality of independently operable piezoelectric actuators supported by the housing, the plurality of piezoelectric actuators positioned radially outward of the central membrane portion and at different angular positions so as to independently adjust pressure on a plurality of angular zones in an annular outer region of the substrate surrounding the central portion of the substrate.

In another aspect, a carrier head for holding a substrate in a polishing system includes a housing and a first flexible membrane secured to the housing to form one or more pressurizable chambers. The first flexible membrane has a lower surface that provides a substrate mounting surface for a central portion of a substrate. A plurality of independently operable piezoelectric actuators are supported by the housing, and the plurality of piezoelectric actuators are positioned radially outward of the first flexible membrane and at different angular positions. An edge control ring that is more rigid than the first flexible membrane is coupled to the plurality of piezoelectric actuators such that the plurality of piezoelectric actuators control a tilt of the edge control ring relative to the housing. The edge control ring is positioned to apply pressure to an annular region on the substrate surrounding the central portion of the substrate.

In another aspect, a polishing system includes a platen to support a polishing pad, a drive shaft, and a carrier head for holding a substrate in a polishing system. The carrier head includes a housing secured to and movable by the drive shaft, a plurality of independently operable piezoelectric actuators supported by the housing and positioned to control pressure on an edge portion of a back surface of a substrate held by the carrier head, the plurality of piezoelectric actuators independently controllable. A control system is configured to control voltages applied to the plurality of piezoelectric actuators such that a position at which a highest pressure is applied to the edge portion of the back surface of the substrate undergoes precession in conjunction with precession of the substrate in the carrier head.

Certain implementations can include one or more of the following advantages. Pressure can be applied to a substrate in a manner that varies both radially and angularly about the center of a substrate being polished. This permits profile control in a manner that can compensate for angular variation in thickness of an incoming substrate and/or angular variations in the polishing rate of the polishing process. The pressure applied over a region can be controlled by expanding or contracting a piezoelectric actuator to deform a membrane on top of the region. Thus, polishing process of each region of the layer on the substrate can be controlled independently and with high definition. Moreover, in comparison to using pressure chambers, using piezoelectric actuators permits scaling to a much larger number of control regions in a more feasible manner. In particular, fewer rotary connections are needed, and the number of rotary connections does not need to scale with the number of piezoelectric actuators.

The details of one or more embodiments of the invention are set forth in the accompanying drawings and the description below. Other features, objects, and advantages are apparent from the description and drawings, and from the claims.

DETAILED DESCRIPTION

Polishing rate variations between different regions of a substrate can lead to the different regions of the substrate reaching their target thickness at different times. On the one hand, the different regions of the substrate may not reach the desired thickness if polishing of the regions is halted simultaneously. On the other hand, halting polishing for different zones at different times can result in defects or lower the throughput of the polishing apparatus. Thus, there is a need to be able to independently control the pressure on different regions.

In an idealized process, due to the rotation of the carrier head and the platen, the polishing rate on a substrate would be angularly symmetric about the axis of rotation of the substrate. In practice however, the polishing process can result in angular variation in the polishing rate. In addition, a substrate to be polished can have a top layer with an initial thickness that varies angularly, i.e., that has angular non-uniformity. Finally, in some manufacturing processes it may be desirable to induce angular non-uniformity in the thickness of the layer being polished in order to compensate for non-uniformity in later processing steps, e.g., deposition steps. Eliminating angular non-uniformity induced by the polishing process or when polishing a layer with an angularly non-uniform initial thickness, or purposely providing angular variation in the thickness when polishing a layer, remains a challenge.

However, a carrier head that uses multiple piezoelectric actuators can address this problem. The piezoelectric actuators can be distributed angularly around the carrier head, and each piezoelectric actuator can be independently controlled, permitting reduction or deliberate introduction of angular non-uniformity.

Figure 1:
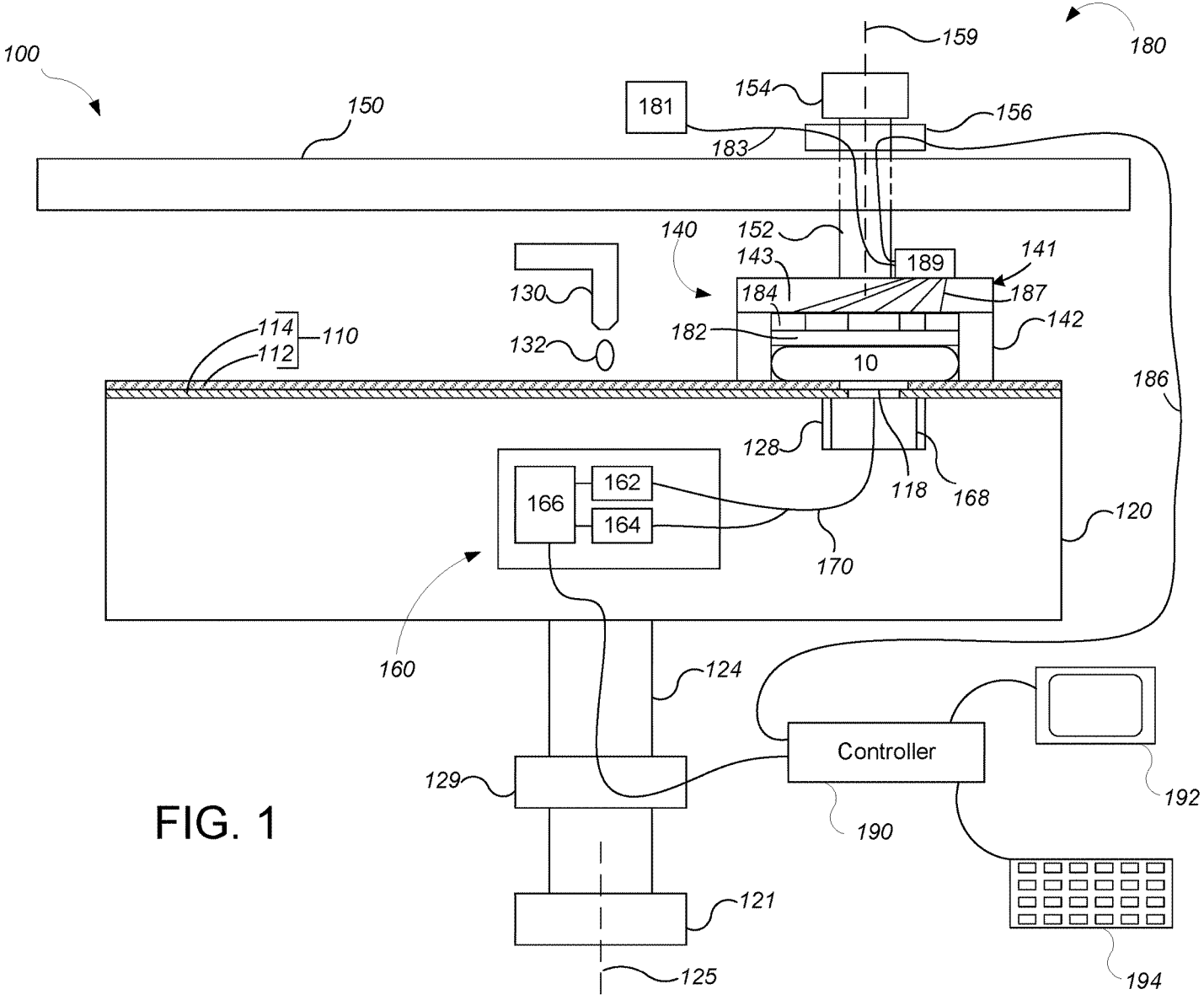
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be detachably secured to the platen 120, for example, by a layer of adhesive. The polishing pad 110 can be a two-layer polishing pad with an outer polishing layer 112 and a softer backing layer 114.

The polishing apparatus 100 can include a combined slurry/rinse arm 130. During polishing, the arm 130 is operable to dispense a polishing liquid 132, such as an abrasive slurry, onto the polishing pad 110. While only one slurry/rinse arm 130 is shown, additional nozzles, such as one or more dedicated slurry arms per carrier head, can be used. The polishing apparatus can also include a polishing pad conditioner to abrade the polishing pad 110 to maintain the polishing pad 110 in a consistent abrasive state.

The polishing apparatus 100 includes a carrier head 140 operable to hold a substrate 10 against the polishing pad 110. The carrier head 140 can be configured to independently control a polishing parameter, for example pressure, for each of multiple zones on the substrate 10.

The carrier head 140 can include a housing 141 that can be connected to a drive shaft 152, a membrane 182, and retaining ring 142 to retain the substrate 10 below the flexible membrane 182. The lower surface of the membrane 182 provides a mounting surface for the substrate 10. The membrane 182 can be made of an elastic material, e.g., rubber, such as silicone rubber or neoprene. The Young's modulus of the membrane 182 can range from 1 to 20 MPa. Other materials, e.g., hydrogel and foam, are possible if they deform in the elastic range with a Young's modulus between 1-10 MP, and have a relatively high shear modulus but a low adhesion so that to avoid "sticking" to the membrane. The membrane 182 can be translucent to adapt for an optical in-situ monitoring system. The membrane 182 can be secured to the housing 141.

The carrier head 140 also includes multiple independently operable piezoelectric actuators 184 positioned above the membrane 182 and secured to a carrier plate 143. The carrier plate 143 can be provided by a portion of the housing 141. The piezoelectric actuators 184 are positioned to contact an upper surface of the membrane 182 so as to independently adjust pressure on the upper surface of the membrane 182. As depicted in the FIG. 1, five piezoelectric actuators 184*a*-184*e* (not individually numbered) are depicted, but this number may be much larger, e.g., twenty to one-hundred actuators. Alternatively, Circuitry 189, e.g., a circuit board having one or more elements such as a microcontroller, is secured to the carrier head 140. For example, the circuitry can be mounted on the top of the housing 141 of the carrier head 140. For another example, the circuitry can be mounted inside the carrier head 140.

The circuitry 189 can receive a voltage on a voltage supply line 183 from a voltage source 181. The circuitry 189 can also receive data through a data line 186 from a controller 190. The voltage supply line 183 and the data line 186 can be routed through the drive shaft 152 and a rotary electrical union 156, e.g., a slip ring, to the stationary components of the voltage source 181 and controller 190.

In addition, the circuitry can independently control a voltage applied to each piezoelectric actuator based on the data, through voltage lines 187. The data line 186 can transfer a plurality of frames of data, and each frame of a plurality of frames can include data that represents a pressure signal, or an equivalent voltage signal, for one or more of the piezoelectric actuators. In some implementations, a frame of data transmitted by the controller 190 includes a control value for each piezoelectric actuator, and the circuitry 189 is configured to determine which control value is associated with each piezoelectric actuator by the order of the control values within the frame. In some implementations, a frame of data transmitted by the controller 190 includes both a control value and an identification value for the piezoelectric actuator to which the control value applies, and the circuitry 189 is configured to determine the appropriate piezoelectric actuator for the control value based on the identification value.

Only two electrical lines, e.g., the voltage supply line 183 and the data line 186, need to be routed through the rotary electrical union 156. Consequently, the assembly can be simpler and more reliable than a pressure actuator that needs rotary connection of multiple fluid lines, e.g., pneumatic air lines. In addition, the number of piezoelectric actuators can be scaled up by appropriate modification of the data provided by the controller 190 and the functionality of the circuitry 189 to interpret the data, without having to increase the number of rotary connections.

Figure 2A:
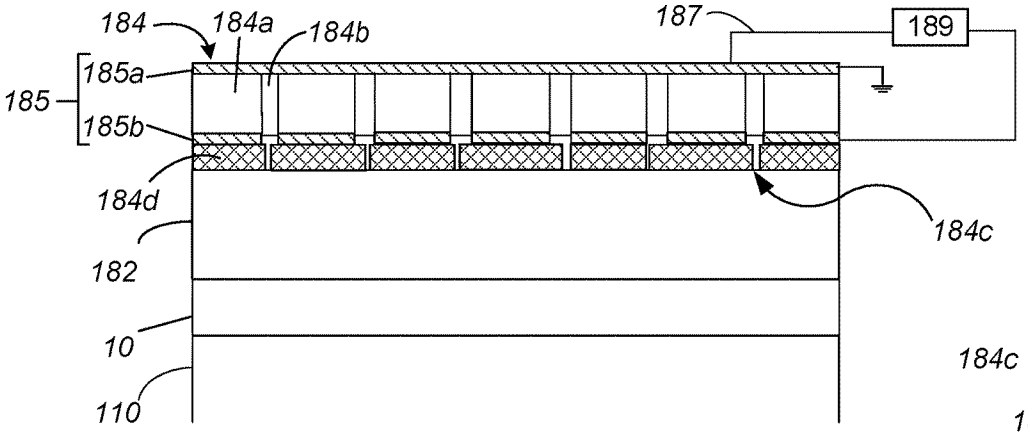
FIG. 2A illustrates an example cross-sectional view of a portion of a carrier head, substrate, and polishing pad showing piezoelectric actuators in the carrier head.
Figure 2B:
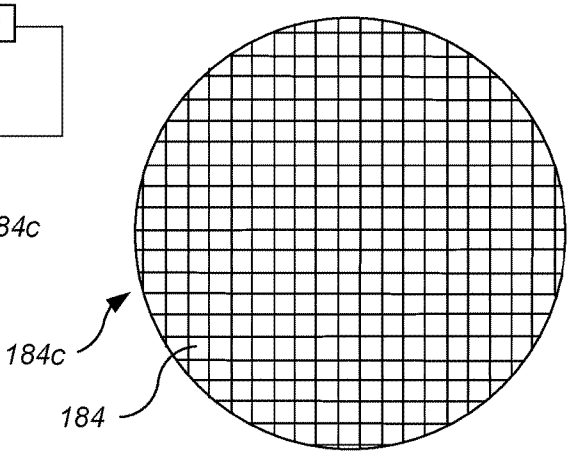
FIG. 2B illustrates a schematic bottom view of a carrier head having piezoelectric actuators in a rectangular array.

FIGS. 2A and 2B illustrate an example cross-sectional view of an array 184*c* of piezoelectric actuators 184 within the carrier head 140 and a bottom view of the array 184*c* of piezoelectric actuators 184, respectively. Each piezoelectric actuator 184 includes a layer 184*a* of piezoelectric material sandwiched between two electrodes 185*a*, 185*b*. To displace an actuator vertically, a voltage is applied between the two electrodes 185*a*, 185*b*. One of the electrodes, e.g., the top electrode 185*a*, can be connected to ground. The other electrode, e.g., the bottom electrode 185*b*, can serve as the control electrode to which the voltage is controllably applied by the circuitry 189.

In some implementations, the top electrode 185*a* is a common ground electrode for all of the piezoelectric actuators 184. In this case, the top electrode 185*a* can span the substrate 10. The individual bottom electrodes 185*b* can be the same size as the segments of the piezoelectric layer actuators. In some implementations, the piezoelectric actuators 184 are of uniform size across the carrier plate 143.

In some implementation, the piezoelectric actuator 184 includes an insulated plate 184*d* attached below the bottom electrode 185*b*. The insulated plate 184*d* need not have the same shape as the remainder of the actuator 184, e.g., the layer 184*a*. That is, the plate 184*d* can be a different shape and size from the piezoelectric layer 184*a*. For example, the insulated plate 184*d* can be larger (laterally) than the piezoelectric layer 184*a*. In addition, the insulated plates 184*d* can have different shapes and sizes so that the shape of the region on the membrane 182 to which pressure is applied by the piezoelectric actuator 184 can vary across the array 184*c*. The shape of the insulated plate 184*d* can be selected based on the desired shape for the zone on the substrate to which pressure will be applied by the actuator. Alternatively, the entire piezoelectric actuator, e.g., the piezoelectric layer 184*a*, and insulated plate 184*d* if present, can be selected based on the desired shape for the zone on the substrate to which pressure will be applied by the actuator.

In some implementations, more than one piezoelectric actuator 184 can be positioned above the same insulated plate 184*d*. In this case, the same voltage signal can be applied to the piezoelectric actuators 184 that are above the same plate 184*d*. Such a configuration where the actuators 184 are relatively small compared to the area spanned by a single plate 184*d*.

Adjacent piezoelectric actuators 184 can be separated by a gap 184*b*. In some implementations, the gaps between adjacent actuators 184 are uniform across the array 184*c*. The piezoelectric actuators can be arranged adjacently with each other to span the entire membrane 182. Gaps 184*b* separating each piezoelectric actuator, e.g., separating the insulated plate 184*d*, are sufficiently small that the pressure applied by the membrane to the substrate is smoothed. The gaps 184*b* can range from 100 um to 1 mm.

The piezoelectric actuators 184 can be disposed at multiple different angular positions around the axis 159. In some implementations, the actuators 184 are disposed in a regular array, e.g., a rectangular, hexagonal, or polar array.

As one example shown in FIG. 2B, the actuators 184 are disposed in a rectangular array. As one example shown in FIG. 2E, the actuators 184 are disposed in a hexagonal array.

Figure 2C:
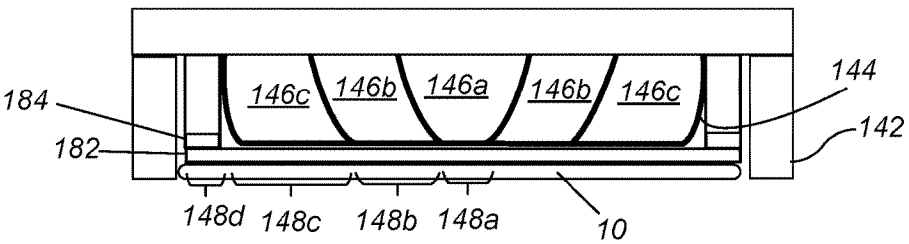
FIG. 2C illustrates an example cross-sectional view of a hybrid carrier head including both piezoelectric control zones and pressure chamber control zones.
Figure 2D:
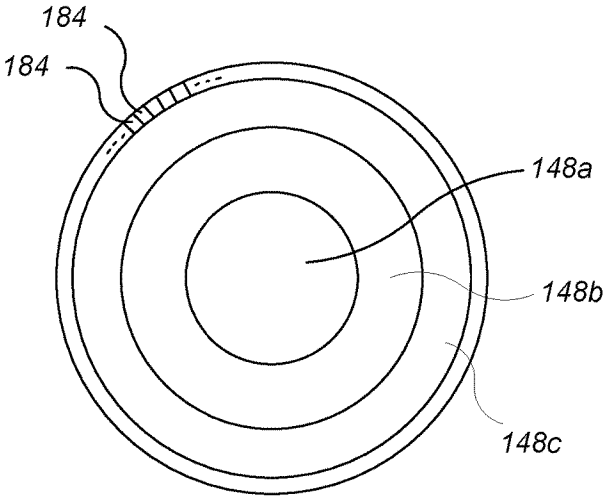
FIG. 2D illustrates a schematic bottom view of the hybrid carrier head with corresponding zones.
Figure 2F:
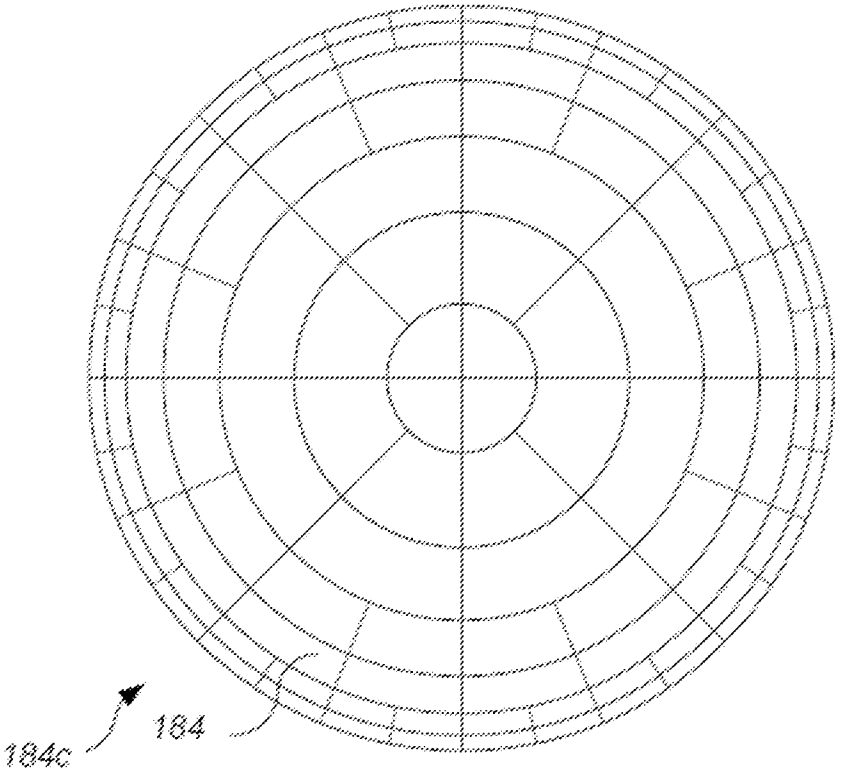
FIG. 2F illustrates a schematic bottom view of a carrier head having piezoelectric actuators in a polar array.

Referring to FIG. 2F, as another example, the actuators can be divided into concentric rings first, and then each actuator within each ring spans a certain amount of arc length. The actuators within a given ring can have a uniform size and/or be spaced uniformly around the ring. In some implementations, the actuators have a uniform size and are spaced uniformly across multiple rings, so there is a larger number of actuators in a ring that is further from the center of the carrier head as compared to a ring that is closer to the center of the carrier head. In some implementations, the actuators in different rings span the same central angle (in degrees/radians), so that actuators in the rings that are further from the center of the carrier head are longer. In some implementations, the actuators can be progressively narrower the further the ring is from the center of the carrier head. In some implementations, the actuators in a first ring can span a smaller angle (in degrees/radians) than the actuators in a second ring that is closer to the center of the carrier head.

The specific shape of the piezoelectric actuators 184 can depend on the array. For example, the piezoelectric actuators 184 can be larger in size with a pie or trapezoidal shape at the center of a substrate 10, while gradually become smaller in size with an arcuate shape toward the substrate edge. The total number of the piezoelectric actuators 184 is driven by the cost of piezoelectric materials. For example, a polishing head using piezoelectric pressure control can have 100 piezoelectric actuators with each of size around 70 $mm^2$.

In some implementations, the angular and radial arrangement of the piezoelectric actuators 184 around a center axis can be non-uniform. For example, if one or more regions in the substrate needs higher definition control than the rest, therein more refined (smaller) piezoelectric actuators can be arranged.

Figure 2E:
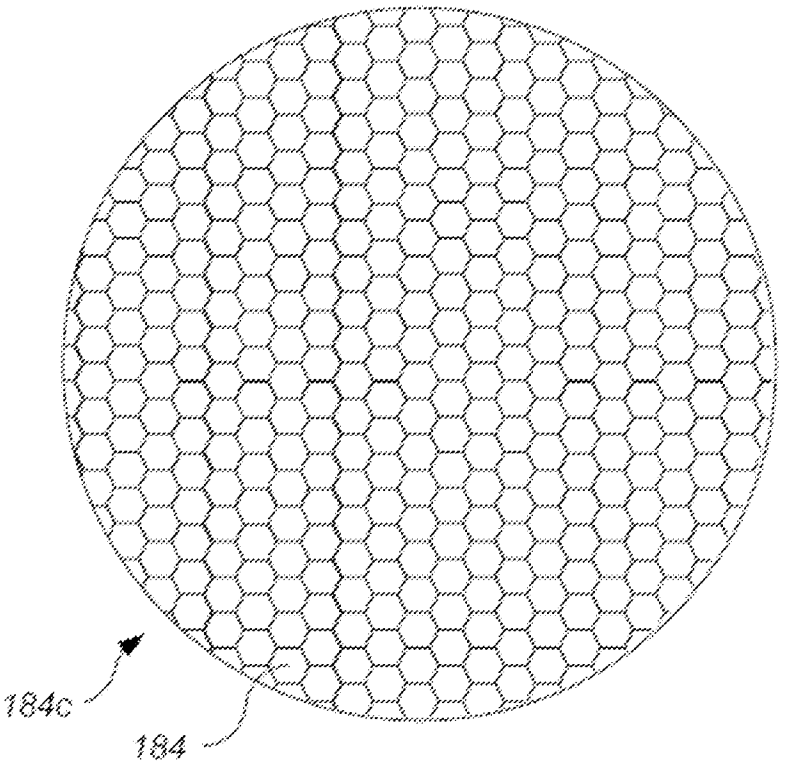
FIG. 2E illustrates a schematic bottom view of a carrier head having piezoelectric actuators in a hexagonal array.

As shown in FIGS. 2B, 2E and 2F, in some implementations the piezoelectric actuators span the substrate 10, e.g., the pressure applied to the substrate is controlled in all regions of the substrate by the entirely by the piezoelectric actuators 184. However, in some implementations, a hybrid approach can be used in which the pressure in one region of the substrate is controlled by piezoelectric actuators and pressure in another region of the substrate is controlled by a pressurized chamber. For example, a carrier head 140 can include a second flexible membrane 144, as shown in FIG. 2C. The outer surface of the second flexible membrane is positioned to contact the upper surface of the first flexible membrane 182. The second membrane 144 is secured to the housing to form one or more independently controllable pressure chambers, e.g. three chambers 146*a*-146*c*, which can apply independently controllable pressure to associated zones 148*a*-148*c* on the flexible membrane 144 and thus on the substrate 10 (see FIG. 2D). The zones comprise a center portion of the substrate 10.

Returning to FIG. 2C, a plurality of piezoelectric actuators 184 are arranged around the second flexible membrane 144 to apply pressure to the membrane 182 at an edge portion of the substrate 148*d* (see FIG. 2D). For example, the piezoelectric actuators 184 can be positioned at uniform angular spacing around the center axis 159. The piezoelectric actuators 184 can be relatively "dense", e.g., at least 1 per 30° around the center axis 159, or at least 1 per 20° around the center axis 159, or at least 1 per 10° around the center axis 159, or at least 1 per 5° around the center axis 159.

Referring to FIGS. 2C and 2D, the center zone 148*a* can be substantially circular, the remaining chamber zones 148*b*-148*c* can be concentric annular zones around the center zone 148*a*, and the piezoelectric zone 148*d* can be a concentric annular zone around the most outside chamber zone 148*c*. Although only three chamber zones and one piezoelectric zone are depicted in FIGS. 2C and 2D, there could be two chamber zones, or four chamber zones or more, and there could be two piezoelectric zones outside the chamber zones, or four piezoelectric zones or more. Although, in FIGS. 2C and 2D, the piezoelectric zone 148*d* are plotted as a concentric ring on the edge portion of the substrate 10, the piezoelectric zones can replace other chamber zones. For example, the center circular chamber zone can be replaced by a circular zone controlled by a plurality of arranged piezoelectric actuators. Whether to use a combination of pressure chambers and piezoelectric actuators can be assessed by multiple factors. For example, factors can be the total cost, efficiency or accuracy of the polishing head 140. For example, the hybrid carrier head can be lower cost than a carrier head that uses exclusively piezoelectric actuators, while still providing improved angular control of polishing rates at the substrate edge where angular non-uniformity is most likely to occur.

Figure 6A:
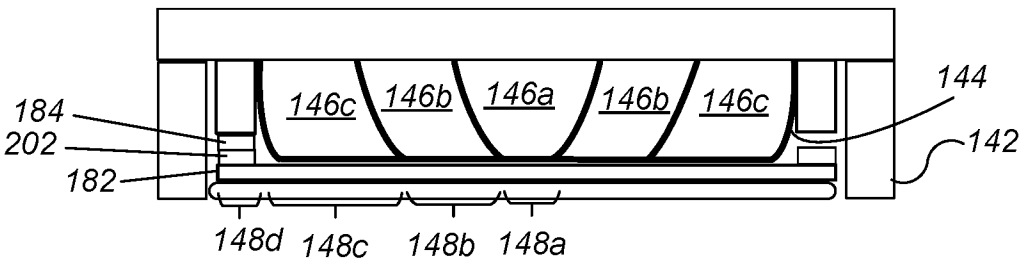
FIG. 6A illustrates an example cross-sectional view of another implementation of a hybrid carrier head including both multiple piezoelectric edge control zones and pressure chamber control zones.
Figure 6C:
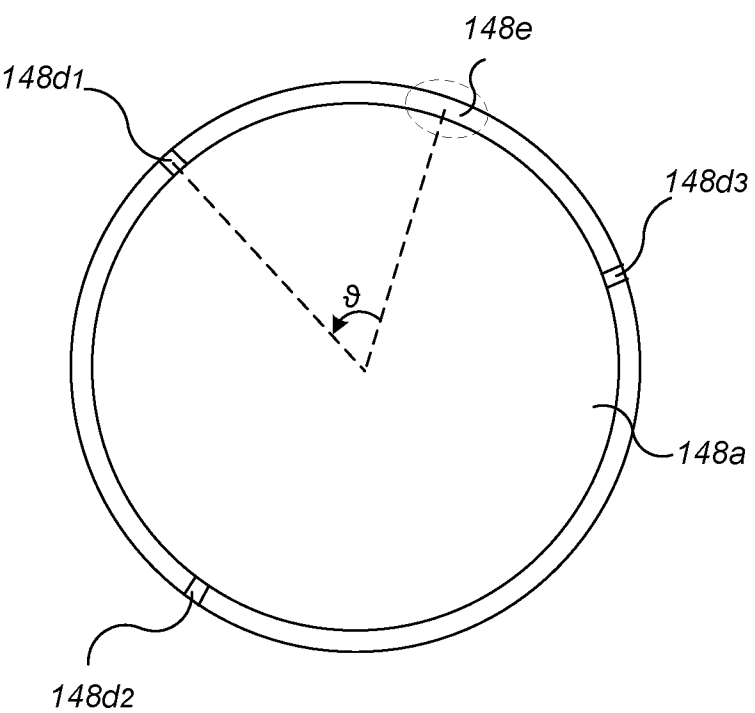
FIG. 6C illustrates a schematic bottom view of the hybrid carrier head including multiple piezoelectric edge control zones and one central pressure chamber control zone.
Figure 6B:
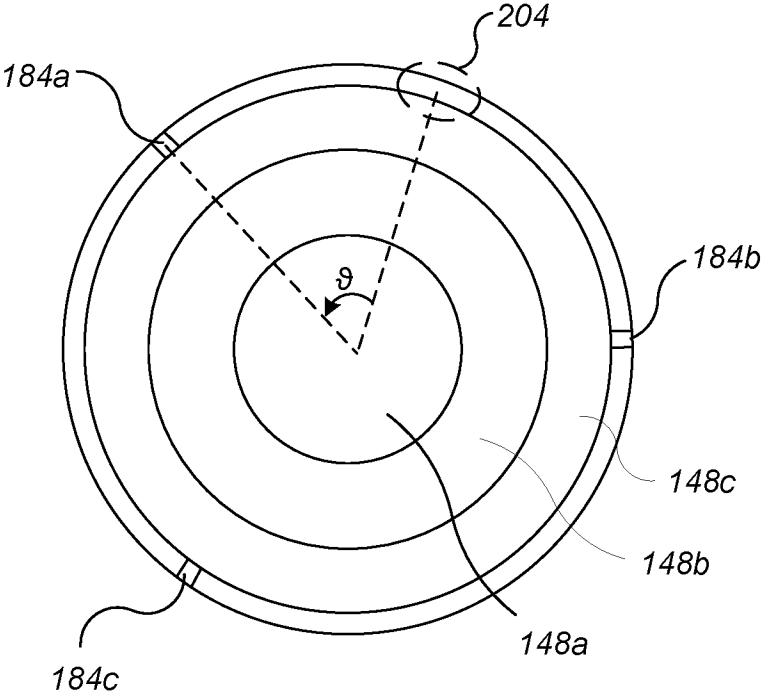
FIG. 6B illustrates a schematic bottom view of the hybrid carrier head of FIG. 6A with an example pressure control scenario.

Referring to FIGS. 6A and 6B, an example hybrid carrier head 140 is shown that is similar to the carrier head illustrated in connection with FIGS. 2C and 2D. However, an edge control ring 202 is placed between the piezoelectric elements 184 and the membrane 182 or substrate 10. The edge control ring can be more rigid than the membrane 182, e.g., can be a hard plastic or thin metal ring. In addition, rather than a large number of piezoelectric actuators closely spaced around the perimeter of loading area, the hybrid carrier head 140 of FIGS. 6A and 6B include a sufficient number of actuators to control both the vertical position and the tilt of the edge control ring 202, e.g., along one axis (in which case just two piezoelectric actuators would be needed), or in two perpendicular axes (in which case just three piezoelectric actuators would be needed). However, additional piezoelectric actuators can be included, in which case the piezoelectric actuators can optionally be used to warp the edge control ring 202 into a desired shape. For example the hybrid carrier head 140 can have six piezoelectric actuators. This would set the vertical position of the edge control ring 202 at six positions, with the edge control ring bending to accommodate different heights at adjacent actuators. The piezoelectric actuators 184 can be evenly spaced around the center of the carrier head.

This example implementation is efficient and economical to reduce angular variation because the controller 190 can control pressure distribution across the edge region using only a few piezoelectric actuators 184 located at different locations above the piezoelectric zone. In particular, by controlling the extension of the piezoelectric actuators, the three piezoelectric actuators 184*a-c*, the skew or tilt of the edge control ring 202 can be controlled, thus adjusting the distribution of pressure on the substrate edge.

During polishing a substrate using the hybrid carrier head 140, the controller 190 can reduce angular variation in the polishing profile at the substrate edge by selecting the vertical extensions of the actuators 184 so to select a position at which the highest or lowest pressure is applied, and the magnitude of the highest and lowest pressures. That is, selection of the vertical positions of the three locations on the edge control ring 202 controls the skew of the ring 202, and the greatest pressure will be applied at the location where the ring 202 is lowest. The lowest pressure will be applied at the location where the ring is highest, which will be 180° from where the greatest pressure is applied so long as the ring remains planar. Pressure should vary relatively uniformly along the perimeter from the location of highest pressure to the location of lowest pressure.

The controller 190 can select the location 204 for the maximum (or minimum) pressure and the magnitude of pressure applied at that location 204 in order to reduce edge non-uniformity. The controller 190 can adjust the orientation (i.e., of the particular edge location 204 to apply the highest local pressure by changing pressures applied at the three locations of the piezoelectric actuators 184*a-c*. For example, if the extension of the actuator 184*a* is largest, actuator 184*b* the second largest, and actuator 184*c* the lowest, the location 204 will be located in the arc region between the two locations of the piezoelectric actuators 184*a*, 184*b*, as shown in FIG. 6B. The relative sizes of the extension of the actuators 184*a-c* will set the magnitude of the highest and lowest pressures.

Similarly, referring to FIG. 6C, the carrier head 140 includes one central pressure chamber control zone 148*a* and multiple piezoelectric actuators 184. The controller 190 can reduce angular variation at the substrate edge when polishing the substrate 10 by adjusting the position at which the highest or lowest pressure is applied, and the magnitude of the highest and lowest pressures.

Returning to FIG. 1, the carrier head 140 is suspended from a support structure 150, e.g., a carousel, and is connected by a drive shaft 152 to a carrier head rotation motor 154 so that the carrier head can rotate about an axis 155. Optionally the carrier head 140 can oscillate laterally, e.g., on sliders on the carousel 150; or by rotational oscillation of the carousel itself. In operation, the platen is rotated about its central axis 125, and each carrier head is rotated about its central axis 155 and translated laterally across the top surface of the polishing pad.

The polishing apparatus can include an in-situ monitoring system 160, which can be used to determine whether to adjust a polishing rate or an adjustment for the polishing rate as discussed below. In some implementations, the in-situ monitoring system 160 can include an optical monitoring system, e.g., a spectrographic monitoring system. In other implementations, the in-situ monitoring system 160 can include an eddy current monitoring system.

In one embodiment, the monitoring system 160 is an optical monitoring system. An optical access through the polishing pad can be provided by a window 118 in the polishing pad 110. The optical monitoring system 160 can include a light source 162, a light detector 164, and circuitry 166 for sending and receiving signals between a remote controller 190, e.g., a computer, and the light source 162 and light detector 164. One or more optical fibers 170 can be used to transmit the light from the light source 162 to the optical access in the polishing pad, and to transmit light reflected from the substrate 10 to the detector 164.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

The light source 162 can be operable to emit white light, and the light detector 164 can be a spectrometer. As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

In some implementations, the light source 162 and detector 164 of the in-situ monitoring system 160 are installed in and rotate with the platen 120. In this case, the motion of the platen will cause the sensor to scan across each substrate. In particular, as the platen 120 rotates, the controller 190 can cause the light source 162 to emit a series of flashes starting just before and ending just after each substrate 10 passes over the optical access. Alternatively, the computing device can cause the light source 162 to emit light continuously starting just before and ending just after each substrate 10 passes over the optical access. In either case, the signal from the detector can be integrated over a sampling period to generate spectra measurements at a sampling frequency.

In operation, the controller 190 can receive, for example, a signal that carries information describing a spectrum of the light received by the light detector for a particular flash of the light source or time frame of the detector. Thus, this spectrum is a spectrum measured in-situ during polishing.

Figure 3A:
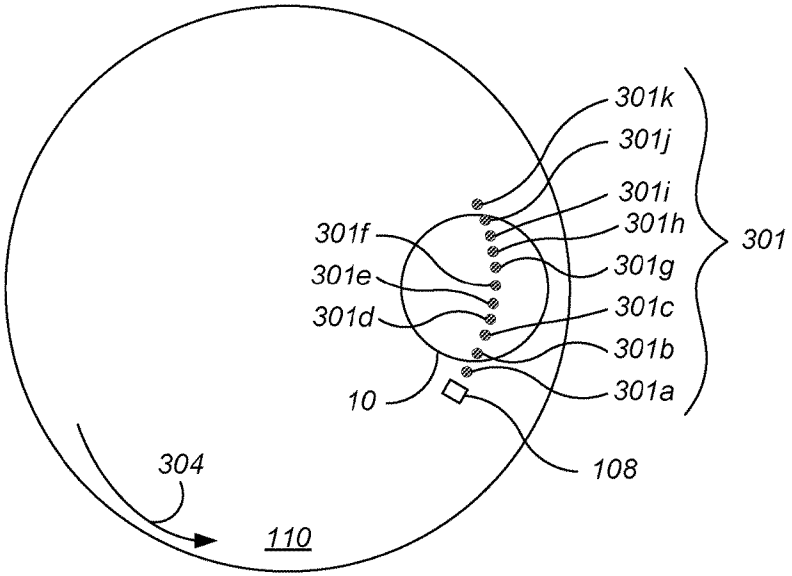
FIG. 3A illustrates a top view of a polishing pad and shows locations where in-situ measurements are taken on a first substrate.

As shown by in FIG. 3A, if the detector is installed in the platen, due to the rotation of the platen (shown by arrow 304), as the window 108 travels below the carrier head, the optical monitoring system will make spectra measurements at a sampling frequency so that the spectra measurements are at locations 301 in an arc that traverses the substrate 10. For example, each of points 301*a*-301*k* represents a location of a spectrum measurement by the monitoring system of the substrate 10 (the number of points is illustrative; more or fewer measurements can be taken than illustrated, depending on the sampling frequency). Due to the rotation of the carrier head 140 as the window 108 sweeps, spectra are obtained from different radii and angular positions on the substrate 10.

Thus, for any given scan of the optical monitoring system across the substrate, based on timing, motor encoder information, optical detection of the edge of the substrate and/or retaining ring, and the optical detection or calculation of the substrate 10 precession with respect to the retaining ring 142, the controller 190 can calculate both the radial position (relative to the center of the particular substrate 10 being scanned) and the angular position (relative to the reference angle of the particular substrate 10 being scanned) for each measured spectrum from the scan.

In many operation conditions, the precession rate of the substrate relative to the carrier head is sufficiently slow that the controller 190 can have enough time to change and apply a new pressure in a particular angular region on the substrate. Thus, in some situations, e.g., if the precession rate of the substrate is less than 10° per minute, e.g., less than 5° per minute, the optical monitoring system can optionally ignore the differences between the angular position of the substrate relative to that of the carrier head and still accurately polish the substrate to have a desired after-polishing profile.

In situations where a non-uniform angular profile is desired for polishing a substrate, the monitoring system can align initial angular positions of the substrate and the carrier head (e.g., based on a notch), and calculate a precession rate of the substrate based on the outer diameter of the substrate, the inner diameter of the retaining ring, and the rotation rate (e.g., rounds per minute) of the carrier head. The system can therefore change pressure applied to a target angular position on the substrate precisely.

In some implementations, the controller 190 can adjust pressures for reducing angular variation during polishing by counter-balancing the observed precession rate of the substrate 10. As an example in connection with FIG. 6B or 6C, the controller 190 can continuously adjust respective pressures applied at different locations (e.g., locations 184*a-c*) in the piezoelectric zone 148*d* to change the angular position of the location 204 where the highest (or lowest) effective local pressure is applied. The orientation (e.g., of the particular location 204 can change at a specific angular speed to counter-balance the precession rate of the substrate 10 with respect to the carrier head 140 so that the effective local pressure applied on a particular region 204 in the substrate 10 seems static with respect to the substrate 10, as if the substrate 10 does not undergo precession.

The polishing system can also include a rotary position sensor, e.g., a flange attached to an edge of the platen that will pass through a stationary optical interrupter, to provide additional data for determination of which substrate and the position on the substrate of the measured spectrum. The controller can thus associate the various measured spectra with the zones 188 or 148*d* (see FIGS. 2B and 2D) on the substrate 10. In some implementations, the time of measurement of the spectrum can be used as a substitute for the exact calculation of the radial position. For angular position, a motor encoder for the motor 154 can provide the angular position of the drive shaft 152 and carrier head 140, which in conjunction with the angular position of the platen provided by an encoder for the motor 121 or the rotary optical interrupter, can be used to determine the angular position of each measurement.

Figure 3B:
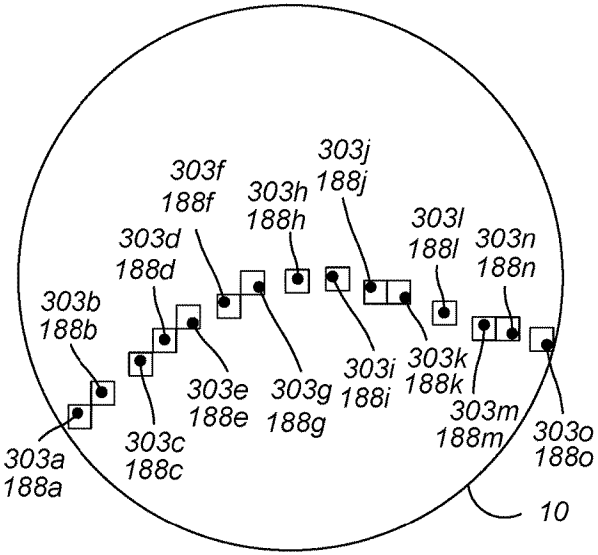
FIG. 3B illustrates a schematic top view of a distribution of multiple locations where in-situ measurements are taken relative to pixelate zones of a substrate.

As an example, referring to FIG. 3B, in one rotation of the platen, spectra corresponding to different locations 303*a*-303*o* are collected by the light detector 164. Based on the radial and angular positions of the locations 303*a*-303*o*, each spectrum collected at locations 303*a*-303*o* is associated with a piezoelectric zone 188*a*-188*o*. Although this example shows that each zone is associated with the same number of spectra, the zones may also be associated with different numbers of spectra based on the in-situ measurements. The number of spectra associated with each zone may change from one rotation of the platen to another. Of course, the numbers of locations given above are simply illustrative, as the actual number of spectra associated with each zone will depend at least on the sampling rate, the rotation rate of the platen, and the radial width of each zone. Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

For each measured spectrum, the controller 190 can calculate a characterizing value. The characterizing value is typically the thickness of the outer layer, but can be a related characteristic such as thickness removed. In addition, the characterizing value can be a physical property other than thickness, e.g., metal line resistance. In addition, the characterizing value can be a more generic representation of the progress of the substrate through the polishing process, e.g., an index value representing the time or number of platen rotations at which the spectrum would be expected to be observed in a polishing process that follows a predetermined progress.

One technique to calculate a characterizing value is, for each measured spectrum, to identify a matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for the matching reference spectrum, a characterizing value can be generated. This technique is described in U.S. Patent Publication No. 2010-0217430.

Another technique is to fit an optical model to the measured spectrum. In particular, a parameter of the optical model is optimized to provide the best fit of the model to the measured spectrum. The parameter value generated for the measured spectrum generates the characterizing value. This technique is described in U.S. Patent Publication No. 2013-0237128. Possible input parameters of the optical model can include the thickness, index of refraction and/or extinction coefficient of each of the layers, spacing and/or width of a repeating feature on the substrate.

Calculation of a difference between the output spectrum and the measured spectrum can be a sum of absolute differences between the measured spectrum and the output spectrum across the spectra, or a sum of squared differences between the measured spectrum and the reference spectrum. Other techniques for calculating the difference are possible, e.g., a cross-correlation between the measured spectrum and the output spectrum can be calculated.

Another technique is to analyze a characteristic of a spectral feature from the measured spectrum, e.g., a wavelength or width of a peak or valley in the measured spectrum. The wavelength or width value of the feature from the measured spectrum provides the characterizing value. This technique is described in U.S. Patent Publication No. 2011-0256805.

Pressure Control Based on the In-Situ Measurements

Generally, a desired thickness profile is to be achieved for the substrate at the end of a polishing process (or at the endpoint time when the polishing process stops). The desired thickness profile may include the same predetermined thickness for all zones of the substrate 10, or different, predetermined thicknesses for different zones of the substrate 10. When multiple substrates with non-uniform initial thicknesses are polished simultaneously, the multiple substrates may have the same desired thickness profile or different desired thickness profiles.

In some implementations, to keep the measured thickness relationships between the control zones and the reference zone similar to or the same as the thickness relationships illustrated by the desired thickness profile(s) at the endpoint time throughout the polishing process, the controller and/or computer can schedule to adjust the polishing rates of the control zones at a predetermined rate, e.g., every given number of rotations, e.g., every 5 to 50 rotations, or every given number of seconds, e.g., every 2 to 20 seconds. In some ideal situations, the adjustment may be zero at the prescheduled adjustment time. In other implementations, the adjustments can be made at a rate determined in-situ. For example, if the measured thicknesses of different zones are vastly different from the desired thickness relationships, then the controller and/or the computer may decide to make frequent adjustments for the polishing rates.

Figure 4:
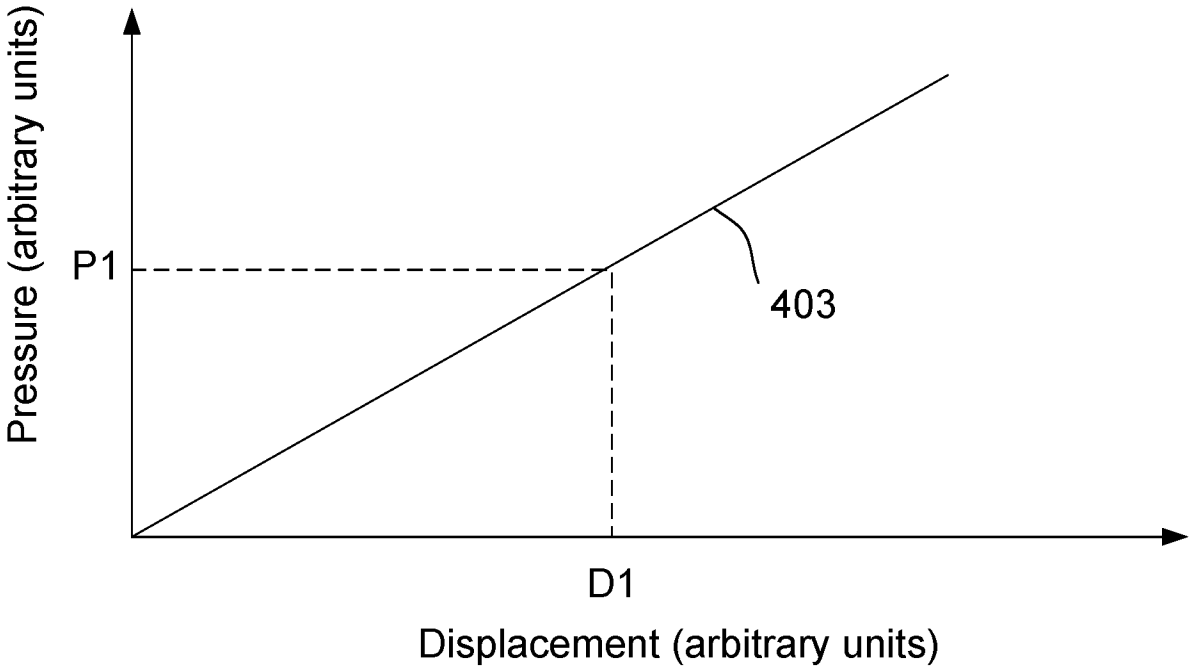
FIG. 4 is a schematic graph of a static formula for determining a pressure applied on a substrate based on a piezoelectric actuator displacement with an elastic membrane between the actuator and substrate.

During polishing, the pressure applied on each region of the layer on a substrate is due to the membrane 182 deformation, and the membrane deformation is controlled by the vertical displacement of the corresponding piezoelectric actuator above that region. By calibrating the Young's modulus of the membrane, a static formula describing the relation between an actuator displacement and a pressure applied on the substrate can be obtained through Hook's law. As shown in FIG. 4, the static formula 403 can output a pressure type of quantity P1 applied on a zone in the layer, when given a displacement type of quantity of an actuator D1 as an input, and vice versa. Although shown as a straight line, the formula function can be a non-linear curve when the membrane is non-linearly elastic. This formula can be used as a sanity check so as to know in advance the range of pressure can be applied onto a plurality of zones in a layer, given the membrane material properties and the piezoelectric actuators motion range. Moreover, a series of look-up-table can be used here as well. For example, given a target pressure 2 Psi to apply onto a control zone in the layer, a desired piezoelectric actuator moving distance can be looked up as, e.g. 14 μm downward, when the membrane is 2 mm thick with a Young's modulus of 2 MPa. For another example, if the moving distance of a piezoelectric actuator is 5 μm downward, fixed, for a certain voltage change, then the actual pressure applied onto a control zone can be looked up as, e.g., 1.8 Psi, when the membrane is 2 mm thick with a Young's modulus of 5 Mpa. For another example, instead of using actuator displacement and the membrane thickness, membrane deformation strain due to the compressive motion of a piezoelectric actuator can be adopted to create another look-up-table.

Figure 5:
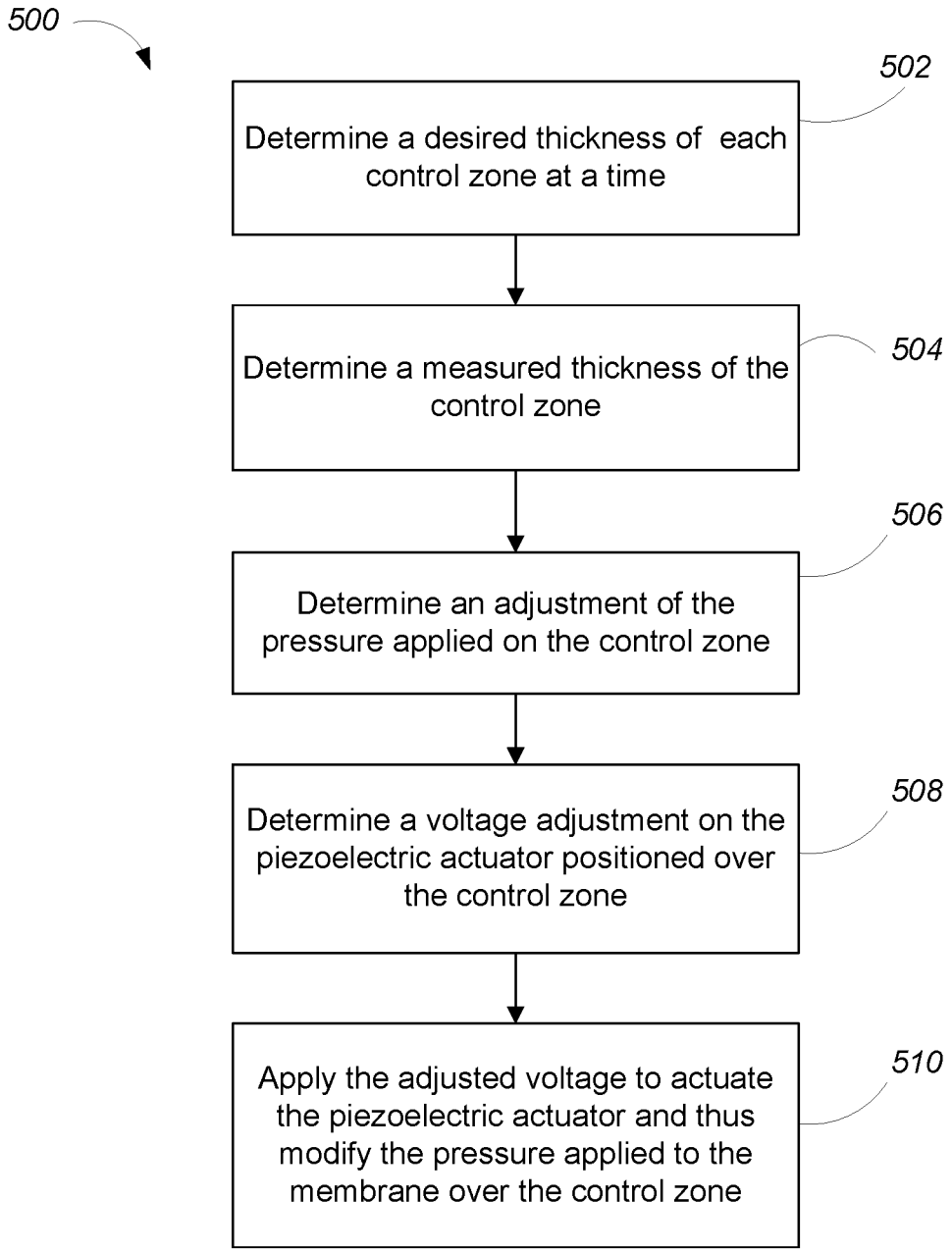
FIG. 5 is a flow diagram showing an example profile control process during polishing a conductive layer with a non-uniform initial thickness.

FIG. 5 illustrates a flow diagram of the control method using piezoelectric actuators (500), which includes determining an expected thickness of each control zone at a projected time (502), determining a measured thickness of the control zone (504), determining an adjustment of the pressure applied on the control zone (506), determining an adjustment of the voltage applied to the piezoelectric actuator over the control zone (508), applying the adjusted voltage to actuate the piezoelectric actuator and thus modify the pressure applied to the membrane over the control zone (510), Steps 502-506 can be realized using an in-situ monitoring system and controller, and step 510 can be carried out on the circuitry 189. Signals representing the desired pressure (or voltage to be applied) for each control zone will be transferred from the monitoring system 160 into the circuitry 189. The control method using piezoelectric actuators, as shown in FIG. 6, is fast enough to adjust pressure given the current frame of signal data, before receiving a next frame of signal data.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Although the description above has focused on control of a chemical mechanical polishing system, the in-sequence metrology station can be applicable to other types of substrate processing systems, e.g., etching or deposition systems.

Embodiments, such as the control system, of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. Alternatively or in addition, the program instructions can be encoded on an artificially generated propagated signal, e.g., a computer-generated electrical, optical, or electromagnetic signal, that is generated to encode information for transmission to suitable receiver apparatus for execution by a data processing apparatus. The computer storage medium can be a computer-readable storage device, a computer-readable storage substrate, a random or serial access memory device, or a combination of one or more of them.

The term "data processing apparatus" refers to data processing hardware and encompasses all kinds of apparatus, devices, and machines for processing data, including by way of example a programmable digital processor, a digital computer, or multiple digital processors or computers. The apparatus can also be or further include special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, a module, a software module, a script, or code, can be written in any form of programming language, including compiled or interpreted languages, or declarative or procedural languages, and it can be deployed in any form, including as a stand alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit). For a system of one or more computers to be "configured to" perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Computers suitable for the execution of a computer program include, by way of example, can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data.

Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

Control of the various systems and processes described in this specification, or portions of them, can be implemented in a computer program product that includes instructions that are stored on one or more non-transitory computer-readable storage media, and that are executable on one or more processing devices. The systems described in this specification, or portions of them, can be implemented as an apparatus, method, or electronic system that may include one or more processing devices and memory to store executable instructions to perform the operations described in this specification.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

Other embodiments are within the scope of the following claims.

What is claimed is:

1. A carrier head for holding a substrate in a polishing system, comprising:

a housing including a carrier plate;

a first flexible membrane secured to the housing, the first flexible membrane having an upper surface and having a lower surface that provides a substrate mounting surface;

a plurality of independently operable piezoelectric actuators secured to the carrier plate and positioned above the first flexible membrane so as to provide independently adjustable compressive pressure on the upper surface of the first flexible membranes; and a plurality of plates placed between the plurality of piezoelectric actuators and the first flexible membrane, each respective plate of the plurality of plates being secured to a respective piezoelectric actuator of the plurality of the piezoelectric actuators to which the respective plate is adjacent without an intervening layer that spans multiple piezoelectric actuators of the plurality of the piezoelectric actuators, the respective plate being laterally larger than the respective piezoelectric actuator.

2. The carrier head of claim 1, wherein respective piezoelectric actuators of the plurality of piezoelectric actuators are arranged at different angular positions around a center axis of the carrier head.

3. The carrier head of claim 2, wherein respective piezoelectric actuators of the plurality of piezoelectric actuators are arranged in a regular array.

4. The carrier head of claim 3, wherein the regular array is a rectangular grid.

5. The carrier head of claim 2, wherein respective piezoelectric actuators of the plurality of piezoelectric actuators are arranged in a plurality of arcuate zones.

6. The carrier head of claim 5, wherein respective arcuate zones of the plurality of arcuate zones are arranged with uniform angular spacing around the center axis of the carrier head.

7. The carrier head of claim 5, wherein respective arcuate zones of the plurality of arcuate zones are arranged with non-uniform angular spacing around the center axis of the carrier head.

8. The carrier head of claim 2, wherein respective piezoelectric actuators of the plurality of piezoelectric actuators are arranged in a plurality of hexagonal or trapezoidal zones.

9. The carrier head of claim 1, wherein the first flexible membrane has an elastic modulus (Young's modulus) between 1 and 20 MPa.

10. The carrier head of claim 1, wherein respective piezoelectric actuators of the plurality of piezoelectric actuators are arranged in a pattern that spans the substrate mounting surface.

11. The carrier head of claim 1, comprising a second flexible membrane secured to the housing to form a pressurizable chamber, wherein an outer surface of the second flexible membrane is positioned to contact the upper surface of the first flexible membrane.

12. The carrier head of claim 11, wherein the second flexible membrane is positioned to apply pressure at a center portion of the substrate mounting surface, and the plurality of piezoelectric actuators are arranged around the second flexible membrane to apply pressure at an edge portion of the substrate mounting surface surrounding the center portion of the substrate mounting surface.

13. The carrier head of claim 1, comprising circuitry secured to the housing to receive a voltage on a voltage supply line, receive data on a data line, and control voltages applied to the plurality of piezoelectric actuators based on the data.

14. The carrier head of claim 13, wherein the circuitry is configured to receive frames of data from a controller on the data line, the data including one or more control values.

15. The carrier head of claim 14, wherein the circuitry is configured to receive frames of data including a sequence of control values in the frames and to identify an actuator to which a control value in the sequence applies based on a position of the control value in the sequence.

16. The carrier head of claim 14, wherein the circuitry is configured to receive frames of data including pairs of values with each pair from the pair of values including a control value and an identification value, and to identify an actuator to which the control value applies based on the identification value.

17. The carrier head of claim 14, wherein the one or more control values represent voltages to apply to the plurality of piezoelectric actuators.

18. A polishing system, comprising:

a platen to support a polishing pad;

a carrier head to hold a substrate against the polishing pad, the carrier head including a housing secured to and rotatable by a drive shaft, the housing including a carrier plate, a first flexible membrane secured to the housing, the first flexible membrane having an upper surface and having a lower surface that provides a substrate mounting surface, a plurality of independently operable piezoelectric actuators secured to the carrier plate and positioned above the first flexible membrane so as to independently adjust compressive pressure on the upper surface of the first flexible membrane, wherein respective piezoelectric actuators of the plurality of piezoelectric actuators are arranged at different angular positions around a center axis of the carrier head, and a plurality of plates placed between the plurality of piezoelectric actuators and the first flexible membrane, each respective plate of the plurality of plates being secured to a respective piezoelectric actuator of the plurality of the piezoelectric actuators to which the respective plate is adjacent without an intervening layer that spans multiple piezoelectric actuators of the plurality of the piezoelectric actuators, the respective plate being laterally larger than the respective piezoelectric actuator;

an in-situ monitoring system to generate a signal that depends on a thickness of a layer on the substrate being polished; and a control system configured to control voltages applied to the plurality of piezoelectric actuators based on the signal from the in-situ monitoring system so as to reduce angular variation in thickness of the layer.

* * * * *